US005647356A

United States Patent [19]

Osendorf et al.

[11] Patent Number: 5,647,356

[45] Date of Patent: Jul. 15, 1997

[54] RESPIRATOR CARTRIDGE WITH SEALING FIT TEST STRUCTURE AND METHOD OF USE

[75] Inventors: Richard J. Osendorf, West St. Paul; David W. Lee, Apple Valley, both of Minn.

[73] Assignee: Donaldson Company, Inc., Minneapolis, Minn.

[21] Appl. No.: 98,792

[22] Filed: Jul. 28, 1993

[51] Int. Cl.[6] ..... A62B 9/04; A62B 7/10; A62B 19/00; A62B 23/02

[52] U.S. Cl. ..... 128/206.17; 128/205.28; 128/205.29; 128/206.12; 128/202.27

[58] Field of Search ..... 128/205.28, 205.29, 128/206.16, 206.17, 206.12, 206.21, 202.27

[56] References Cited

U.S. PATENT DOCUMENTS

| | | | |
|---|---|---|---|
| 923,776 | 6/1909 | Danielewicz | 128/205.29 |
| 2,195,563 | 4/1940 | Fils | 128/206.17 |
| 2,227,959 | 1/1941 | Cover | 128/206.17 |
| 2,744,523 | 5/1956 | Malcom, Jr. et al. . | |
| 2,744,524 | 5/1956 | Whipple . | |
| 2,744,525 | 5/1956 | Whipple . | |
| 2,751,904 | 6/1956 | Lewis . | |
| 2,845,927 | 8/1958 | Hill . | |
| 3,161,491 | 12/1964 | Gongoll et al. | 128/206.17 |
| 3,521,630 | 7/1970 | Westberg et al. | 128/206.24 |
| 4,088,461 | 5/1978 | Brauer . | |
| 4,179,274 | 12/1979 | Moon . | |
| 4,197,841 | 4/1980 | Brauer et al. . | |
| 4,383,956 | 5/1983 | Croft et al. . | |
| 4,548,626 | 10/1985 | Ackley et al. . | |
| 4,714,486 | 12/1987 | Silverthorn | 128/205.29 |
| 4,945,907 | 8/1990 | Tayebi | 128/206.12 |
| 4,989,598 | 2/1991 | Berg et al. . | |
| 5,033,507 | 7/1991 | Pouchot . | |
| 5,035,239 | 7/1991 | Edwards . | |
| 5,036,844 | 8/1991 | Pouchot et al. . | |
| 5,038,775 | 8/1991 | Maruscak et al. . | |
| 5,052,385 | 10/1991 | Sundstrom . | |
| 5,080,094 | 1/1992 | Tayebi | 128/206.12 |
| 5,094,236 | 3/1992 | Tayebi | 128/206.12 |
| 5,158,077 | 10/1992 | Sundstrom . | |

FOREIGN PATENT DOCUMENTS

| | | | |
|---|---|---|---|
| 146700 | 7/1936 | Australia | 128/206.17 |
| 865696 | 4/1941 | France | 128/206.17 |
| 22533 | 9/1956 | Germany | 128/206.17 |
| 1124364 | 2/1962 | Germany | 128/206.17 |
| 2100661 | 7/1972 | Germany | 128/206.17 |
| 102415 | 8/1963 | Norway | 128/206.17 |

OTHER PUBLICATIONS

Donaldson Company, Inc. brochure, entitled *Donaldson High Purity Products,* dated 1992, 2 pages. (Exhibit A).

Lab Safety Supply Catalog pages, entitled *Personal & Environmental Safety,* 1992 General Catalog–Winter/Spring Edition, cover pages and pages 80–81, dated 1991. (Exhibit B).

Lyons Safety Catalog pages, entitled *The Occupational Health & Safety Catalog* vols. 15–32, cover page and p. 77. (Exhibit C).

Product page for North respirators and respirator cartridges, p. 27. (Exhibit D).

*Primary Examiner*—Kimberly L. Asher

*Attorney, Agent, or Firm*—Merchant, Gould, Smith, Edell, Welter & Schmidt, P.A.

[57] ABSTRACT

A respirator cartridge is disclosed including a gas cartridge and a particulate cartridge. The gas cartridge is joined to the particulate cartridge with a double-sided adhesive seal including a closed cell foam central portion. The particulate cartridge is provided with a plenum defining an air inlet with a length and width sized smaller than a user's finger to permit the user's finger to close off the air intake of a respirator during a fit check. A release liner covers one face of the adhesive seal prior to assembly of the particulate cartridge to the gas cartridge. Indicia regarding use of the particulate cartridge may be provided on the release liner.

25 Claims, 5 Drawing Sheets

RESPIRATOR CARTRIDGE WITH SEALING FIT TEST STRUCTURE AND METHOD OF USE

FIELD OF THE INVENTION

The present invention relates to respirators including replaceable respirator filter cartridges.

BACKGROUND OF THE INVENTION

Air purifying respirators, such as respirator masks, protect users by filtering out harmful particulates and gases from environments in which it is not safe to breathe the air. Replaceable cartridges on the respirators contain the filter element or elements for filtering the particulates and/or gases. These cartridges are typically disposable after use. Various concerns arise with respect to the replaceable cartridges.

A first area of concern relates to providing appropriate filter elements when the user desires to breathe air containing a plurality of harmful substances. In some cases both harmful particulates and harmful gases are present. The replaceable cartridge must include both filtering capabilities to permit the user to safely breathe in that particular environment. Further, the types of gases, and the types of particulates can vary widely from environment to environment. Filter elements with filtering capabilities for only certain substances may be desired.

In a respirator, it is known to provide a first filter element for filtering particulates and a second filter element for filtering gases. These two elements can be assembled to form a single cartridge. In the past, two separate cartridges, a gas cartridge (with a gas filter element) and a particulate cartridge (with a particulate filter element), were provided and then assembled together to form the single cartridge. The particulate cartridge was attached to the gas cartridge through one of: a solvent bond, an adhesive bond, a mechanical crimp, or an ultrasonic weld.

Various specific concerns arise with respect to the attachment structure between the two cartridges. Ease of manufacture and assembly is one concern. Other concerns are durability and dependability during operation. A poor seal between the particulate cartridge and the gas cartridge can be harmful to the user.

A second area of concern with respect to respirator cartridges relates to problems associated with the air inlet to the cartridge. The air inlet may expose the filter element disposed within the cartridge to easy damage by a foreign object protruding through the air inlet. Once damaged, the filter element may lose filtering capability, possibly causing harm to the user. The air inlet may draw contaminated air from an area around the user having a high concentration of contaminants. This will result in more frequent replacement of the respirator cartridge. The user may need to initially test the seal of the respirator face mask against the user's face whereby the user needs to seal the air inlet or inlets during the testing procedure. Ease of closure of the inlet or inlets during the fit check, or seal check, is important. In the past, the palm of the hand was used to close the inlet. This can be awkward for the operator and difficult or impossible for persons with small palms.

There is a need in the art for respirator cartridges for respirators and methods which address the above concerns and other concerns.

SUMMARY OF THE INVENTION

One aspect of the invention relates to a respirator cartridge including a first cartridge housing construction defining a passageway for air, and a first filter arrangement in the first cartridge housing construction for filtering air passing through the passageway. A seal member is provided with a first field of adhesive to adhere the seal member to the first cartridge housing construction. A second field of adhesive is provided for adhering the seal member to a second cartridge housing construction. The second cartridge housing construction defines a passageway for air and includes a second filter arrangement for filtering air passing through the passageway of the second cartridge housing construction.

The first filter arrangement may include a filter media for filtering particulates from the air. The second filter arrangement of the second cartridge housing construction may include a filter media for filtering a gas or gases from the air. The seal member may include a release liner positioned to cover the second field of adhesive on the seal member prior to mounting of the first cartridge housing construction to the second cartridge housing construction. In one preferred embodiment, the seal member is a resilient closed cell foam and the fields of adhesive each comprise a layer of pressure sensitive adhesive.

Another aspect of the present invention relates to a respirator cartridge including a filter arrangement for filtering air, and a cartridge housing construction defining a passageway for the air, with the filter arrangement being disposed in the passageway. The cartridge housing construction further defines an air inlet having an elongated slotted configuration with a length and width sized smaller than a user's finger, such that the air inlet can be closed off by the user's finger during a fit check of a respirator mask.

A further aspect of the present invention relates to a respirator cartridge including a first cartridge housing construction with a first filter arrangement and defining an air inlet having an elongated slotted configuration with a length and a width sized smaller than a user's finger, and a seal member with a central portion and at least one, and preferably two adhesive fields for adhering the first cartridge housing construction to a second cartridge housing construction with a second filter arrangement, with the seal member disposed between the first and the second cartridge housing construction.

Another aspect of the present invention relates to a method of using a respirator cartridge wherein a first cartridge is provided with a seal member adhesively attached to the first cartridge. A release liner is removed from the seal member to expose a field of adhesive. A second cartridge is then adhesively attached to the field of adhesive of the seal member to form the respirator cartridge.

A further aspect of the present invention relates to a method of using a respirator cartridge wherein a respirator mask is provided with a respirator cartridge, the mask is mounted to the face of the user, and the user positions a finger over an air inlet to the respirator cartridge to close the air inlet. The user then performs a mask seal check by attempting to draw air through the mask.

A further aspect of the invention relates to a method of attaching a first cartridge to a second cartridge with an adhesive seal member to form a respirator cartridge, mounting the respirator cartridge to a respirator mask, mounting the mask to the face of a user, positioning a finger over the air inlet to the respirator cartridge, and then performing a mask seal check.

BRIEF DESCRIPTION OF THE DRAWINGS

In the drawings in which like reference numerals indicate corresponding parts throughout the several views.

DETAILED DESCRIPTION OF THE PREFERRED EMBODIMENTS

Figure 1:
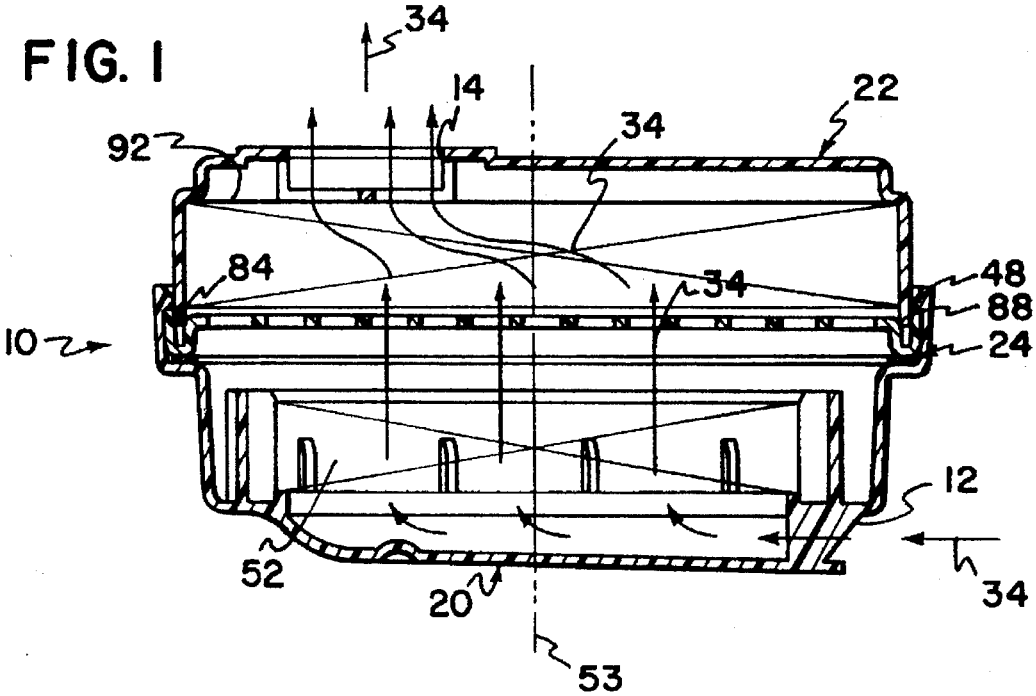
FIG. 1 is a cross-sectional assembly view of a respirator cartridge according to the present invention.
Figure 2:
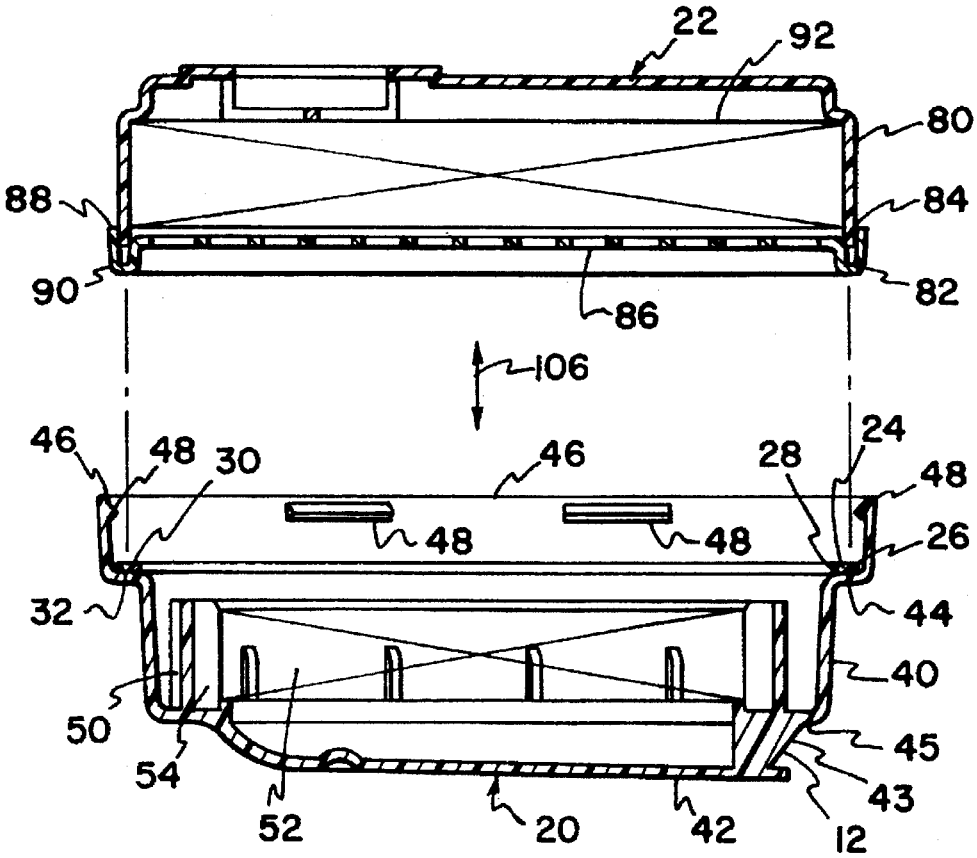
FIG. 2 is an exploded cross-sectional view of the respirator cartridge shown in FIG. 1.

Referring now to FIGS. 1 and 2, a first embodiment of a respirator cartridge 10 is shown. Respirator cartridge 10 includes an air inlet 12 and an air outlet 14. Respirator cartridge 10 defines a passageway for air entering inlet 12 to travel to outlet 14. Contained within an interior of cartridge 10 is a filter arrangement for filtering particulates and one or more gases from the air passing through cartridge 10.

Figure 8:
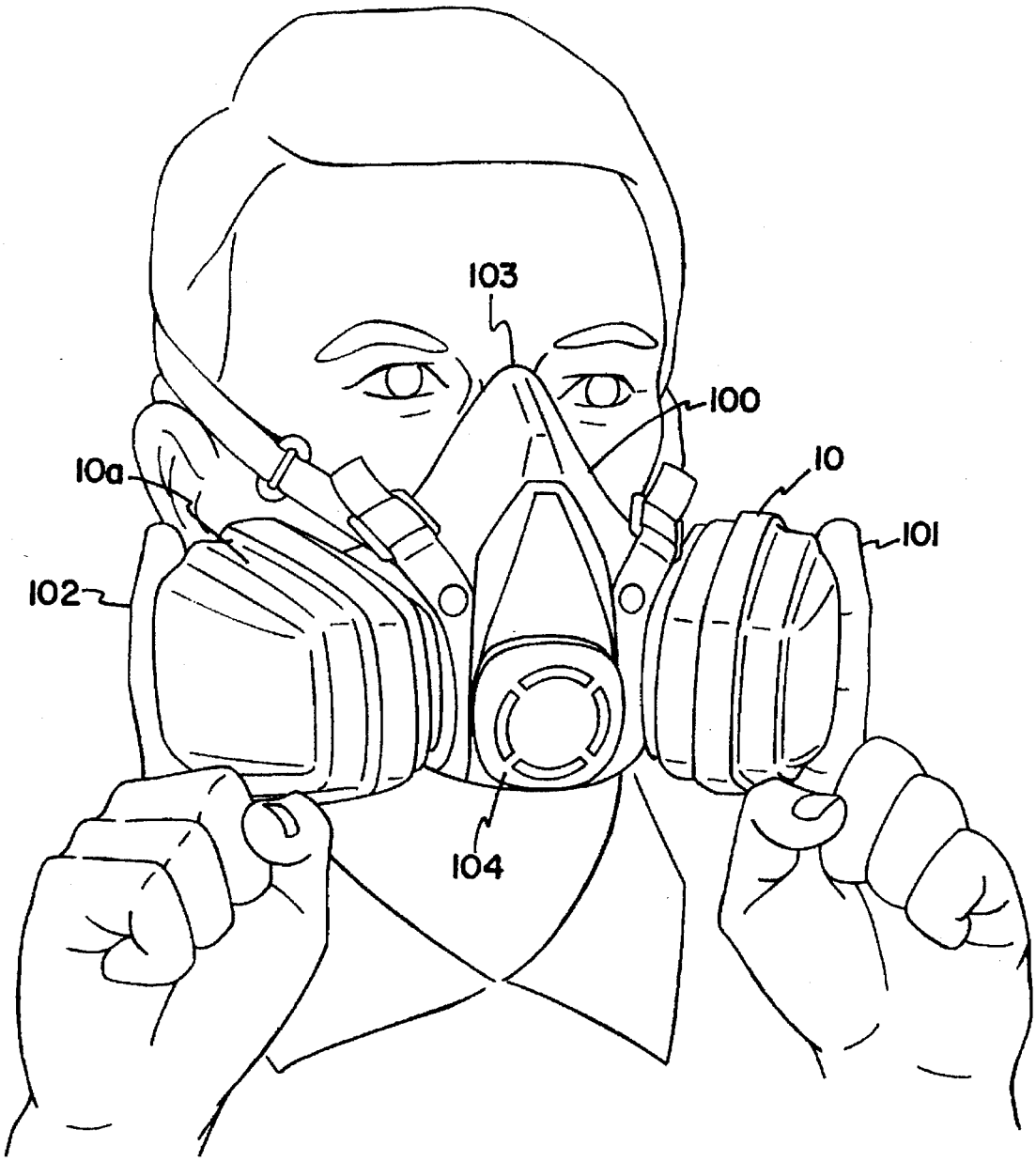
FIG. 8 shows two respirator cartridges of the type shown in FIG. 1 attached to a respirator mask and worn by a user.

FIG. 1 shows respirator cartridge 10 in the assembled state ready for use with a respirator mask 100 (see FIG. 8). In FIG. 1, air flow arrows 34 show the air flow path through respirator cartridge 10. Outlet 14 typically mounts to a fitment on the respirator mask, such as an outlet tube with a plurality of protrusions (not shown) which each engage one of a plurality of arcuate slots on outlet 14 of cartridge 10 in a twist lock arrangement.

In the preferred embodiment, respirator cartridge 10 includes a particulate cartridge 20 and a gas cartridge 22. Particulate cartridge 20 is mounted to gas cartridge 22 with adhesive seal member 24 (hereinafter "seal" or "adhesive seal"). Adhesive seal 24 provides an airtight seal between particulate cartridge 20 and gas cartridge 22.

Figure 3:
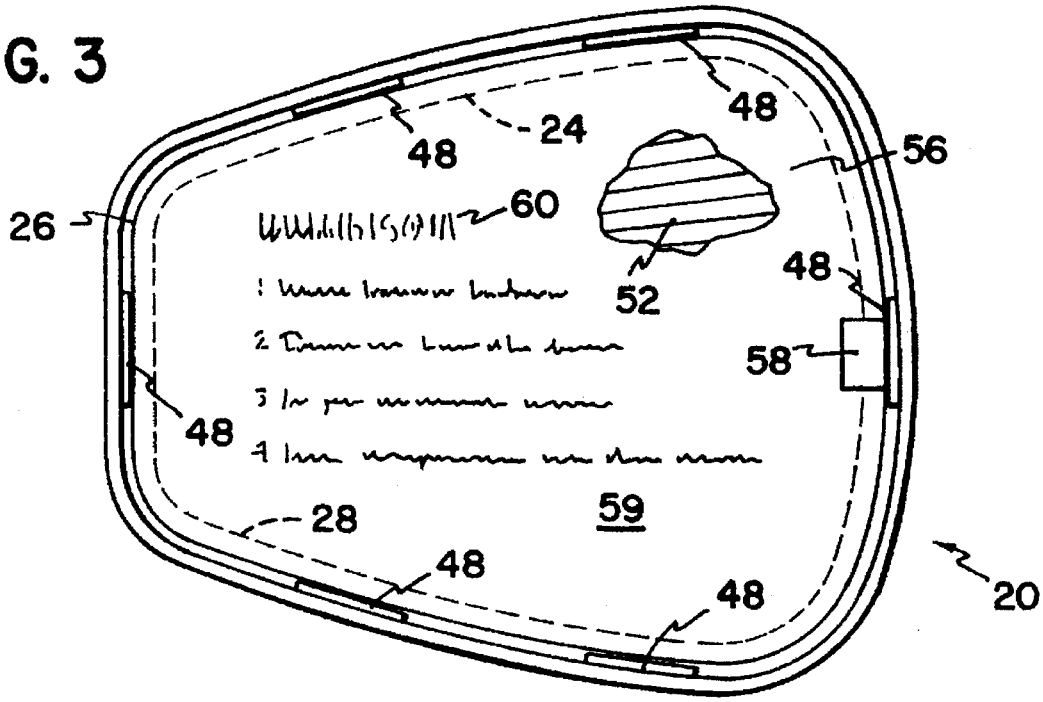
FIG. 3 is a top view of the particulate cartridge shown in FIGS. 1 and 2, showing the release liner in position before removal.

Adhesive seal 24 extends peripherally about an inside of respirator cartridge 10 in a generally truncated triangular shape (see FIG. 3). The shape of seal 24 is generally dictated by the shape of respirator cartridge 10 and the shapes of the surfaces of particulate cartridge 20 and gas cartridge 22 to be joined together. It is to be appreciated that any of a variety of shapes are possible for seal 24 and cartridge 10 (see, for example, FIG. 9).

Adhesive seal 24 includes an outer surface 26 defining an outer periphery of adhesive seal 24. An inner surface 28 defines an inner periphery of adhesive seal 24. At least a portion of first surface 30 all the way around seal 24 is adhesively sealed to gas cartridge 22 in the assembled state shown in FIG. 1. At least a portion of second surface 32 on an opposite side of adhesive seal 24 all the way around seal 24 is sealed to particulate cartridge 20, such as with an adhesive seal.

Particulate cartridge 20 includes a first filter arrangement 52 comprising a filer media for filtering particulates. One example of a filter media for removing particulates includes a pleated filter media of fiberglass or other suitable particulate filtering material (see FIG. 3). Gas cartridge 22 includes a second filter arrangement 92 comprising a filter media for removing one or more gases from the air passing through the filter media. One example of a filter media for removing gases includes activated carbon particles, like charcoal, or other suitable material which removes particular gases from the air passing through respirator cartridge 10.

It is to be appreciated that different cartridges can be joined together via adhesive seal 24. A user of respirator cartridge 10 can select an appropriately designed gas cartridge 22 from a plurality of different cartridges to be adhesively sealed via adhesive seal 24 to an appropriately designed particulate cartridge 20, possibly selected from a plurality of different cartridges. The gas cartridges can vary in the type of filter media for removing different gases. In this manner, a user of respirator cartridge 10 can select the appropriate filter media for filtering the particulates and/or gas or gases to be encountered by the user during operation. This may result in a reduction in inventory since an assembled cartridge 10 does not need to be maintained for every anticipated usage. Only the appropriate separate cartridges for particulates and gases need to be maintained and then joined at the appropriate time before desired usage. Cartridge 20 can even be configured as a gas cartridge for removing a different gas or gases than gas cartridge 22. The two gas cartridges can then be assembled together in accordance with the invention with adhesive seal 24.

Figure 4:
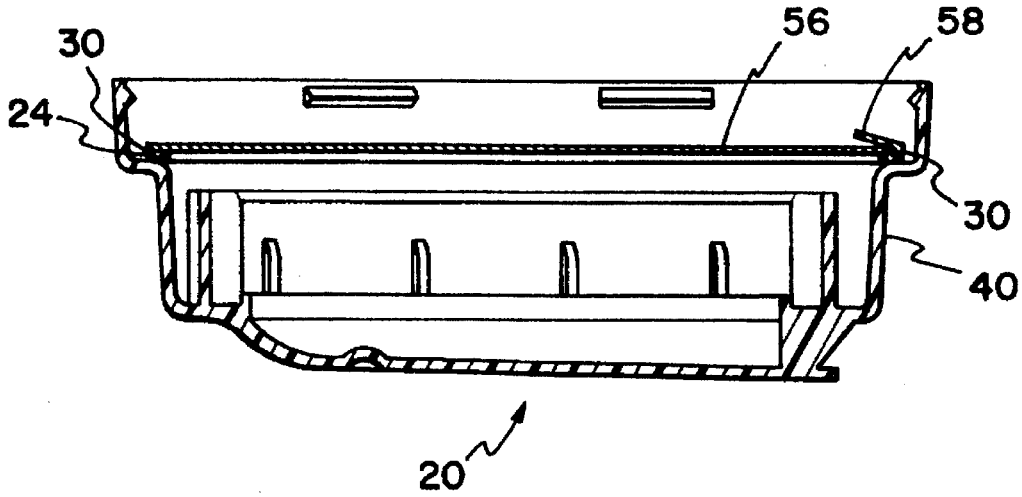
FIG. 4 is a cross-sectional side view of the particulate cartridge shown in FIG. 3.
Figure 5:
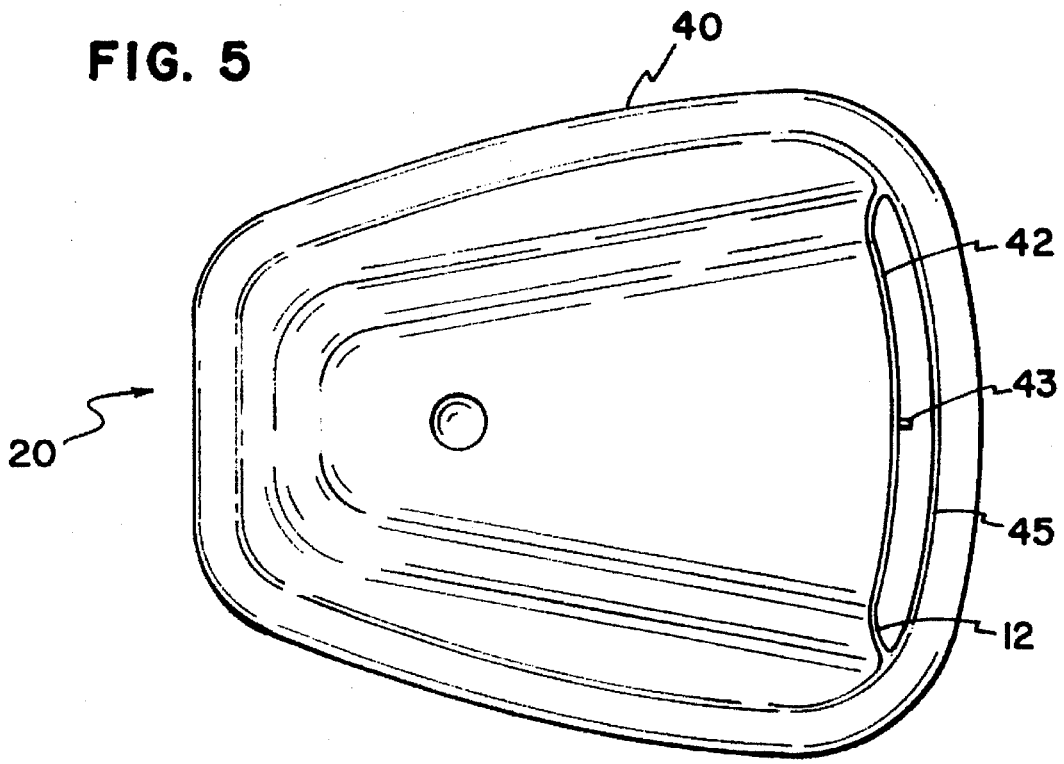
FIG. 5 is a bottom view of the particulate cartridge shown in FIGS. 3 and 4.
Figure 6:
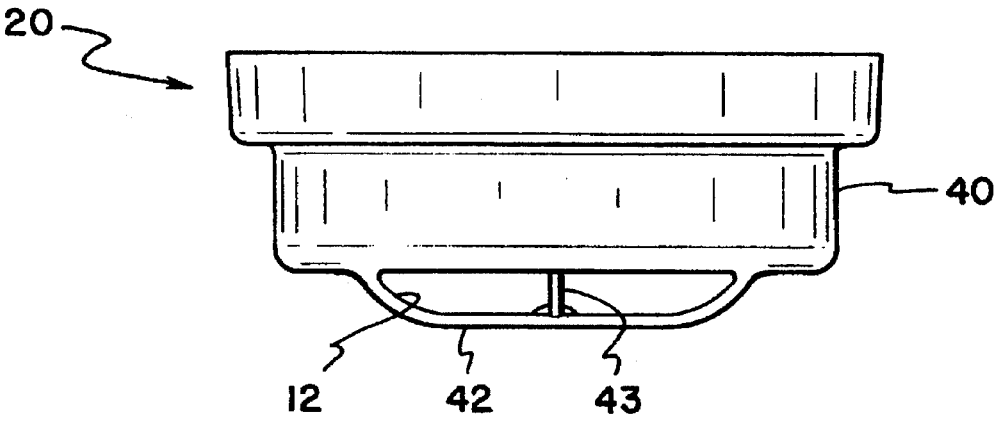
FIG. 6 is an end view of the particulate cartridge shown in FIGS. 3 through 5.

Referring now to FIGS. 3 and 4, particulate cartridge 20 is shown prior to assembly with gas cartridge 22. As shown in FIGS. 3 and 4, a release liner 56 covers first surface 30 of adhesive seal 24. Release liner 56 includes a pull tab 58 for convenient grasping by the user's fingers. Release liner 56 further includes a top surface 59 for receiving indicia 60, such as instructions regarding the proper assembly and use. User warnings can also be specifically identified. During assembly of respirator cartridge 10 it is quite likely that the user will have to look toward top surface 59 of release liner 56 to locate tab 58. This may help insure that the user's attention is directed toward indicia 60.

As shown in FIGS. 3 and 4, release liner 56 generally completely covers the first surface 30 of adhesive seal 24 and the opening defined by the inner surface 28. Release liner 56 which completely covers the opening defined by inner surface 28 helps to protect the filter media contained within particulate cartridge 20. It is to be appreciated that release liner 56 need only be appropriately shaped to protect the adhesive of first surface 30 prior to assembly if protection of the filter media is not desired.

It is to be appreciated that seal 24 may be initially mounted to gas cartridge 22, with release liner 56 being removed to expose the adhesive of second surface 32 for joining gas cartridge 22 to particulate cartridge 20.

Particulate cartridge 20 includes a body 40 defining a thin walled housing structure. Body 40 may be made from molded plastic, such as polystyrene or polypropylene, for example. As shown in FIGS. 1, 2, 5 and 6, air inlet 12 is formed by plenum portion 42 which defines an elongated slotted opening for air inlet 12. A support 43 supports a middle region of plenum portion 42 to space plenum portion 42 an appropriate distance from base portion 45. As will be discussed below, air inlet 12 defined by plenum portion 42 and base portion 45 is generally shaped appropriately large enough to permit entry of air in a sufficient amount for breathing by the user of the respirator cartridge 10 and yet air inlet 12 is also sized smaller than a length and a width of the front surface of the user's finger, preferably the index finger, for seal testing purposes. In some respirator masks, two cartridges 10 may be used during breathing by the user (see, for example, FIG. 8). Therefore, each cartridge would supply about one half of the air for breathing.

Preferably, air inlet 12 has a total area approximately equal to the area of the airflow path exiting outlet 14 and entering the area of the respirator mask around the user's face. An air inlet 12 sized at about ¼ to 5/16 inches wide and about 2 to 2 and ¼ inches long works well to be closed off by an index finger of many adult persons. The width dimension is the narrower dimension relative to the length dimension. As the width and/or length become larger, less adult persons will be able to adequately close off air inlet 12 during testing. A slight curvature provided in air inlet 12, best shown in FIG. 5, to conform to the curvature of a slightly forwardly bent finger works well also. As shown in FIG. 1, air inlet 12 angled at about 37.5 degrees away from longitudinal axis 53 also works well. This angle is measured from an edge of plenum portion 42 to an edge of base portion 45 relative to axis 53.

Body 40 of particulate cartridge 20 further defines a platform 44 for engaging second surface 32 of adhesive seal 24. Body 40 also includes a lip 46 circumferentially surrounding an open end of particulate cartridge 20. A plurality of inwardly facing tabs 48 are located adjacent lip 46 to assist in mounting particulate cartridge 20 to gas cartridge 22. During use, tabs 48 engage lip 88 of gas cartridge 22, as shown in FIG. 1. Preferably, lip 46 is resilient and tabs 48 include a tapered surface to engage a tapered shaped region on gas cartridge 22 to permit ease of assembly by moving lip 46 outward when gas cartridge 22 is received within lip 46 of particulate cartridge 22. After lip 88 clears each of tabs 48, tabs 48 and lip 46 snap generally inwardly toward a center of respirator cartridge 10 past an outer edge of lip 88. It is to be appreciated that tabs 48 are optional. However, tabs 48 cooperate with adhesive seal 24 to securely mount particulate cartridge 20 to gas cartridge 22. Moreover, tabs 48 provide a convenient structure for indicating to the user that the cartridge 10 is assembled. In some cases, a clicking noise will be emitted once lip 88 clears tabs 48.

Particulate cartridge 20 further includes a filter support 50 for holding first filter arrangement 52. In one preferred embodiment, a potting material 54 sealingly joins the pleated filter media of first filter arrangement 52 to filter support 50 to seal the inside of the body 40 to the filter media whereby all of the air entering at inlet 12 must pass through the filter media.

Referring now to FIGS. 1 and 2, gas cartridge 22 includes a first body portion 80 defining a thin walled housing structure. A second body portion 82 defines a thin walled housing structure which cooperates with the first body portion 80 to define an enclosed region for second filter arrangement 92. As shown in FIG. 1, first body portion 80 fits inside the outer periphery of second body portion 82. Gas cartridge 22 generally defines a similar truncated triangular shape as shown in FIG. 3 for particulate cartridge 20. First body portion 80 and second body portion 82 are made from plastic, such as polystyrene or polypropylene, for example. Attachment techniques, such as an adhesive bond, a solvent bond, an ultrasonically weld, or other means for joining two plastic members together holds and seals first body portion 80 to second body portion 82 at region 84. First body portion 80 defines a generally circular opening for outlet 14 which twist locks respirator cartridge 10 to a respirator mask. On an opposite side of gas cartridge 22 is a central portion 86 defining at least one opening to permit air flow to pass through from particulate cartridge 20 to second filter arrangement 92 to be filtered by second filter arrangement 92.

Gas cartridge 22 includes a support surface 90 for engaging first surface 30 of adhesive seal 24 to sealingly join gas cartridge 22 to particulate cartridge 20. Second body portion 82 includes previously noted lip 88 for engaging tabs 48 on particulate cartridge 20.

Second filter arrangement 92 includes a filter media containing activated carbon, such as charcoal, or some other material specifically selected to remove one or more particular gases present in the atmosphere to be breathed, such as by adsorption of the gas or gases. Second filter arrangement 92 is fixed or otherwise arranged within an interior of gas cartridge 22 such that all air passing through gas cartridge 22 passes through second filter arrangement 92.

Figure 7:
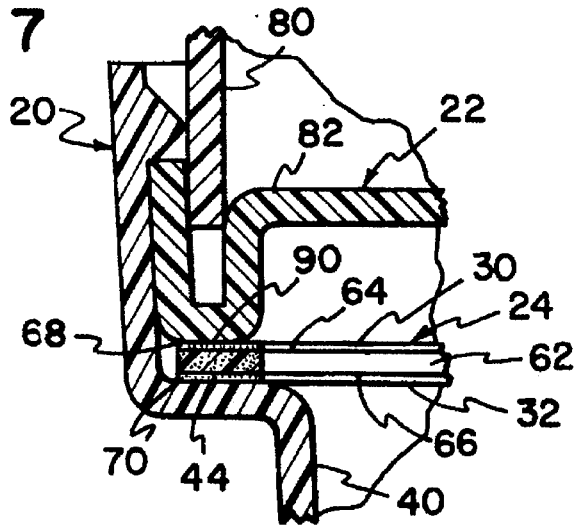
FIG. 7 is an enlarged cross-sectional view of the seal arrangement of the respirator cartridge shown in FIG. 1.

Referring now to FIG. 7 an enlarged schematic of the adhesive seal arrangement between gas cartridge 22 and particulate 20 is shown. Adhesive seal 24 preferably includes a compressible and resilient central portion 62 having a generally rectangular cross-sectional area with a top surface 64, and a bottom surface 66 spaced apart from top surface 64. A top field 68 of adhesive forms at least a portion of surface 30 of seal 24 and is positioned at least partially between top surface 64 of central portion 62 and support surface 90 of gas cartridge 22. A bottom field 70 of adhesive forms at least a portion of surface 32 of seal 24 and is positioned at least partially between bottom surface 66 of central portion 62 and platform 44 of particulate cartridge 20. Such adhesive arrangement exists completely around the periphery of respirator cartridge 10. Fields 68,70 can be each be an adhesive layer which covers all of top surface 64 and bottom surface 66, respectively, of seal 24 as shown in FIG. 7 to define surfaces 30,32. However, appropriately positioned fields 68,70 can be utilized to mount particulate cartridge 20 to gas cartridge 22 without completely covering top surface 64 and bottom surface 66 of central portion 62.

Field 68 of adhesive holds central portion 62 against surface 90 to maintain an airtight seal between an inside of cartridge 10 and an exterior of the cartridge. Similarly, field 70 of adhesive holds central portion 62 against surface 44 to maintain an airtight seal between an inside of cartridge 10 and the exterior. The fields 68,70 of adhesive help prevent an air bypass to develop should central portion 62 lose resiliency, such as due to compression setting. Central portion 62 is preferably sufficiently resilient to permit an airtight seal to be formed as seal 24 pushes against particulate cartridge 20 and gas cartridge 22 without the presence of fields 68,70 of adhesive when cartridges 20,22 are held together by the snap arrangement including tabs 48 and lip 88.

In one preferred embodiment, central portion 62 of adhesive seal 24 is about 0.060 inch thick and about 0.19 inches wide around the periphery of cartridge 10 and is made from a closed cell foam, such as polyethylene, neoprene, or urethane. In FIG. 7, the preferred fields 68,70 of adhesive are layers completely covering top surface 64 and bottom surface 66 and include pressure sensitive adhesives such as acrylic-based or rubber-based adhesives. It is to be appreciated that fields of 68,70 of adhesive may include multiple layers of adhesives and carrier layers. It is also to be appreciated that central portion 62 could be joined to platform 44 by different adhesive than the adhesive of field 68 or by other techniques besides the use of adhesive field 70.

As one example for adhesive seal 24, a VOLARA® foam, types A or E (cross-linked polyolefin foams) by Duraco, Inc., of Chicago, Ill. may work well for central portion 62. A synthetic rubber based pressure sensitive adhesive designated #1128 or an acrylic based pressure sensitive adhesive designated #1129, both by Lundell Manufacturing Corporation of Minneapolis, Minn., may work well as adhesive fields 68,70 with the VOLARA® foam as central portion 62 to adhesively join central portion 62 to particulate cartridge 20 and to the gas cartridge 22. Scotch™ adhesive tapes, designated Y-4482 or Y-4484 (polyethylene foam with R45 rubber based adhesive on each side) by the 3M Company of St. Paul, Minn. are also believed to work well for seal 24.

To assemble respirator cartridge 10, particulate cartridge 20 is provided as shown in FIGS. 3 and 4. Central portion 62 is previously adhesively or otherwise attached to particulate cartridge 20. With the fingers or other grasping means, the user grasps hold tab 58 of release liner 56 to expose top field 68 of adhesive of adhesive seal 24. Gas cartridge 22 is moved toward particulate cartridge 20 in the direction of arrow 106 as shown in FIG. 2. An outer periphery of second body portion 82 pushes tabs 48 generally outwardly until tabs 48 clear a top edge of lip 88 as shown in FIG. 1. Support surface 90 becomes adhesively sealed to adhesive seal 24. Once sealed, air being drawn from respirator cartridge 10 at outlet 14 can only come from air inlet 12. This insures that all air exiting cartridge 10 via outlet 14 will be filtered by the filter arrangement contained within respirator cartridge 10.

Referring now to FIG. 8, once cartridge 10 is assembled, cartridge 10 can be mounted to a respirator mask 100. A second cartridge 10*a* identical to cartridge 10 is mounted to mask 100. Together, cartridges 10,10*a*, and mask 100 form a respirator mask unit 103 (also referred to as a "respirator") as shown in FIG. 8 for purifying contaminated air for the user to breathe. It is to be appreciated that mask 100 may be configured to work with only a single cartridge 10. Respirator mask 100 in FIG. 8 is configured to fit over the nose and mouth of the user. Alternatively, respirator mask 100 may cover the eyes also. Mask 100 includes an outlet 104 for exhaled air. Appropriate valving structure associated with respirator mask 100 permits proper air flow into and out of the mask to filter the air via respirator cartridges 10,10*a* during breathing by the user.

Prior to use in the contaminated environment, a user will mount respirator 103 to the user's face over the user's nose and mouth. The user will test the seal of mask 100 against the user's face. In order to effect such test, the user must close the known air inlets into mask 100. As shown in FIG. 8, the user is closing off the air inlet 12 of each cartridge 10,10*a*. As shown in FIG. 8, the user is able to close off the air inlet of each cartridge 10, 10*a* by only using a slightly curved index finger 101 (front surface) of the left hand with respect to cartridge 10, and the other index finger 102 (front surface), slightly curved, of the right hand with respect to cartridge 10*a*. At this point, the user inhales. If a suction or vacuum develops within respirator mask 100, then the user is assured of a good seal against the user's face. If no vacuum develops, then air is entering respirator mask 100 without passing through the filter arrangement associated with each respirator cartridge 10,10*a*. In this manner, the user can easily test whether the user has properly fitted the mask 100 through the use of only one finger per cartridge.

Various advantages result with the present invention. First, with the use of adhesive seal 24, particulate cartridge 20 can be applied to gas cartridge 22 either at the factory or in the field. Such attachment permits a supplier, or even an ultimate consumer, to assemble respirator cartridges 10 for particular needs by mixing and matching various different particulate cartridges 20 and gas cartridges 22. For example, various gas cartridges 22 may be provided for filtering out different gases, such as one of: organic vapors, chlorine, hydrogen chloride, sulfur dioxide, ammonia, methylamine, formaldehyde, etc. These cartridges can be mixed and matched with one or more particulate cartridges 20 by the supplier or the ultimate consumer, depending on the particular needs of the user. Various particulate cartridges 20 may be provided depending on the particulates that may need to be filtered such as dusts, mists, asbestos, and radionucleides of various sizes.

Another advantage of the present invention is that the use of the preferred adhesive seal 24 does not require the use of any solvents to bond the cartridges together, and therefore the solvents will not be able to contaminate the gas removing material in the gas cartridge 22 during assembly.

The preferred adhesive seal 24 also conforms well to irregular surfaces to ensure a positive seal between particulate cartridge 20 and gas cartridge 22. The preferred adhesive seal 24 may perform better in cold environments compared to sealant techniques such as hot melts. No special assembly equipment is needed to mount the two cartridges together. In the event a respirator cartridge 10 is dropped, the air-tight seal between gas cartridge 22 and particulate cartridge 20 is less likely to be disturbed due to the central portion 62 comprising a resilient material such as closed cell foam providing a shock absorptive means to allow the adhesive bond to stay intact in the preferred embodiment.

Further advantages of the present invention include that the first filter arrangement 52 within particulate cartridge 20 of the preferred embodiment is protected from damage from mechanical protrusions such as a sharp object being passed through the grill of a traditional cartridge, which in turn could severely compromise the performance of the filter. Also, as shown in FIG. 8, the air inlet of each respirator cartridge 10,10*a* is generally directed away from the individual user's field of work. Thus, in applications where the user may be creating dusts, mists, fumes, etc., such as by sanding, spray painting, or chemical spraying, the cartridge will intake less of the contaminant since air is only being drawn from an area of less concentration of the contaminant.

The preferred embodiment of the present invention also allows for the user to perform a fit check of the respirator mask 100 much easier than is now commonly done since it is only necessary for the user to place a single finger over the opening of each cartridge 10,10*a* to seal off the air inlet, instead of the entire palm, for example.

Figure 9:
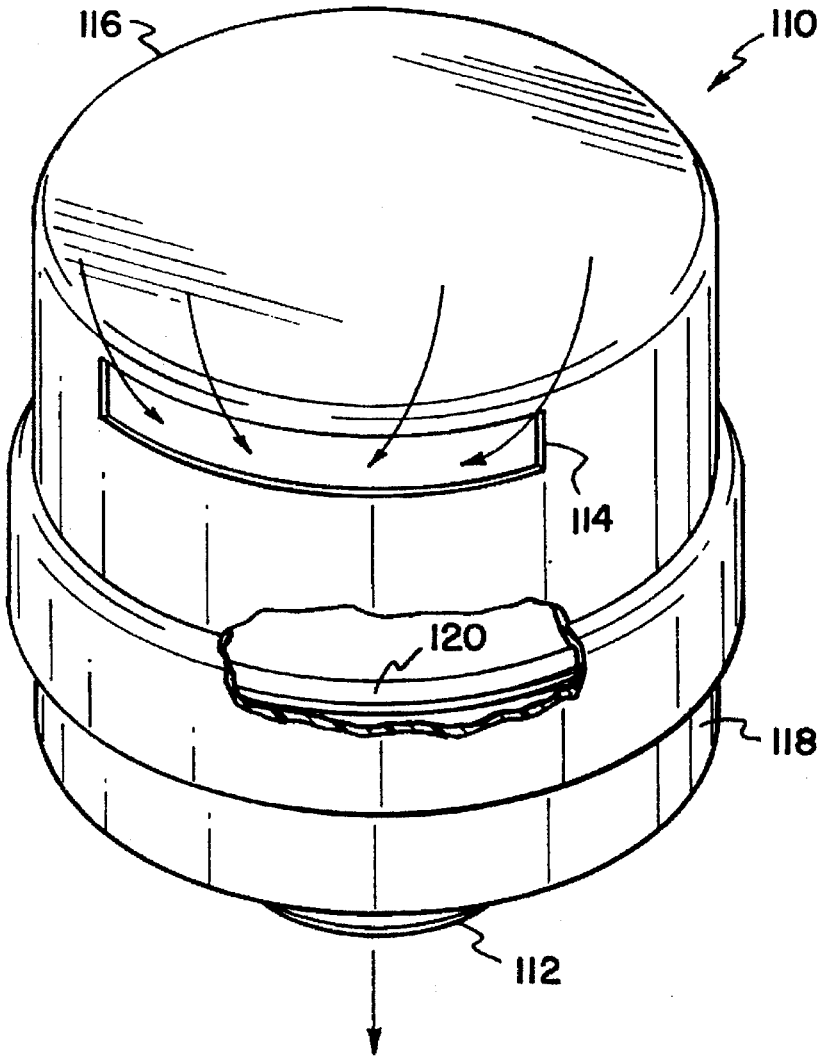
FIG. 9 is a perspective view of an alternative embodiment of a respirator cartridge.

Referring now to FIG. 9, an alternative preferred embodiment of a respirator cartridge 110 is shown. Respirator cartridge 110 includes a generally cylindrical outer shape. Outlet 112 threadably mounts to a respirator mask (not shown). Inlet 114 is generally slot-shaped with a length and width generally smaller than a finger of a user, preferably an index finger, and having an arcuate configuration which is defined by a partial radius. In cylindrical respirator cartridge 110, particulate cartridge 116 is joined to gas cartridge 118 via an adhesive seal 120 similar in many respects to adhesive seal 24. However, adhesive seal 120 generally defines a circular inner periphery and a circular outer periphery, instead of the truncated triangular shape of adhesive seal 24.

It must be understood, however, that even though numerous advantages and characteristics of the invention have been set forth in the foregoing description, together with details of the structure and function of the invention, the disclosure is illustrative only, and changes may be made in detail, especially in matters of shape, size and material components within the principals of the invention, to the full extent indicated by the broad, general meanings of the terms in which the appended claims are expressed.

What is claimed is:

1. A respirator cartridge comprising:

a first cartridge housing construction defining a passageway for air;

a first filter arrangement disposed in the first cartridge housing construction for filtering air passing through the passageway of the first cartridge housing construction;

a seal member including:

a central portion comprising a resilient compressible material;

a first field of adhesive adhering the central portion to the first cartridge housing construction; and a second field of adhesive on the central portion which is not adhering the central portion to the first cartridge housing construction;

the first cartridge housing construction including a planar platform wherein the first field of adhesive adheres the central portion of the seal member to the planar platform;

the first cartridge housing construction further including a lip surrounding the planar platform.

2. The respirator cartridge of claim 1, further comprising:

a second cartridge housing construction defining a passageway for air; and a second filter arrangement for filtering air passing through the passageway of the second cartridge housing construction, wherein the second field of adhesive is between the central portion of the seal member and a portion of the second cartridge housing construction and the second field of adhesive adheres the central portion of the seal member to the second cartridge housing construction.

3. The respirator cartridge of claim 2, further comprising snap means for snap fitting the first cartridge housing construction to the second cartridge housing construction.

4. The respirator cartridge of claim 2, wherein the first filter arrangement includes a pleated particulate filter media, and wherein the second filter arrangement includes a gas filter media.

5. The respirator cartridge of claim 2, further comprising:

a respirator mask sized to fit over a user's face; and means for mounting the second cartridge housing construction to the respirator mask.

6. The respirator cartridge of claim 5, wherein the first cartridge housing construction includes a plenum defining an elongated slotted opening in communication with the passageway through the first cartridge housing construction, the elongated slotted opening having a maximum length greater than a maximum width wherein the elongated slotted opening is sized smaller than a user's finger.

7. The respirator cartridge of claim 6, wherein the first cartridge housing construction includes an edge, and wherein the elongated slotted opening is disposed on the edge of the first cartridge housing construction.

8. The respirator cartridge of claim 7, wherein the edge is curved.

9. The respirator cartridge of claim 1, further comprising a removable release liner, wherein the second field of adhesive is positioned between the central portion of the seal member and the release liner.

10. The respirator cartridge of claim 9, wherein the release liner covers the passageway through the first cartridge housing construction.

11. The respirator cartridge of claim 10, wherein the release liner includes printed indicia regarding use of the respirator cartridge.

12. The respirator cartridge of claim 1, wherein the first cartridge housing construction includes a plenum defining an elongated slotted opening in communication with the passageway through the first cartridge housing construction, the elongated slotted opening having a maximum length greater than a maximum width wherein the elongated slotted opening is sized smaller than a user's finger.

13. The respirator cartridge of claim 12, wherein the first cartridge housing construction includes an edge, and wherein the elongated slotted opening is disposed on the edge of the first cartridge housing construction.

14. The respirator cartridge of claim 13, wherein the edge is curved.

15. The respirator cartridge of claim 1, wherein the central portion of the seal member comprises a closed cell foam material.

16. The respirator cartridge of claim 1, wherein the first field of adhesive and the second field of adhesive each comprises pressure sensitive adhesive.

17. A respirator cartridge comprising:

a filter arrangement for filtering air;

a cartridge housing construction defining a passageway for the air, the filter arrangement disposed in the passageway, the cartridge housing construction having a curved side wall portion defining an air inlet to the passageway, the air inlet having an elongated slotted configuration with a length and a width sized smaller than a user's finger wherein a maximum length is greater than a maximum width, the curved side wall portion having a curvature sized to match the curvature of the user's finger in a forwardly curved state, whereby the user's finger closes the air inlet to the cartridge housing construction when the user's forwardly curved finger is positioned over the air inlet.

18. The respirator cartridge of claim 17, further comprising:

a respirator mask sized to fit over a user's face; and means for mounting the cartridge housing construction to the respirator mask.

19. The respirator cartridge of claim 18, wherein the curved side wall portion is positioned on the cartridge housing construction so as to face away from a front of the mask when the cartridge housing construction is mounted to the respirator mask.

20. The respirator cartridge of claim 17, wherein the cartridge housing construction has a cylindrical shape, the curved side wall portion forming a portion of the cylindrical shape.

21. The respirator cartridge of claim 17, wherein the cartridge housing construction has a generally truncated triangular shape with a wide end and a narrow end, the curved side wall portion forming a portion of the wide end.

22. A method of using a respirator cartridge comprising the steps of:

providing a first cartridge portion having a first filter arrangement contained with the first cartridge portion for filtering air;

providing a seal member attached to the first cartridge portion;

removing a release liner to expose an adhesive field of the seal member; and attaching a second cartridge portion having a second filter arrangement to the exposed adhesive field of the seal member to form an airtight seal between the first cartridge portion and the second cartridge portion thereby forming the respirator cartridge, wherein the respirator cartridge defines an air inlet and an air outlet to provide for an air passageway through both the first and second cartridge portions, wherein the air outlet of the respirator cartridge defines an attachment mechanism for removably attaching to a respirator mask.

23. The method of claim 22, further comprising the steps of:

mounting the attachment mechanism of the air outlet of the respirator cartridge to a respirator mask to form a respirator;

mounting the respirator to the face of a user;

positioning a user's finger over the air inlet to the respirator cartridge, the air inlet having an elongated slotted configuration with a length and a width sized smaller than the user's finger wherein a maximum length is greater than a maximum width; and performing a seal check of the respirator.

24. A respirator cartridge for a respirator mask comprising:

a first cartridge housing construction defining a passageway for air;

a first filter arrangement disposed in the first cartridge housing construction for filtering air passing through the passageway of the first cartridge housing construction;

a seal member including:

a central portion comprising a resilient compressible material;

a first field of adhesive adhering the central portion to the first cartridge housing construction; and a second field of adhesive on the central portion which is not adhering the central portion to the first cartridge housing construction;

the first cartridge housing construction including a planar platform wherein the first field of adhesive adheres the central portion of the seal member to the planar platform;

the first cartridge housing construction further including a lip surrounding the planar platform;

a second cartridge housing construction defining a passageway for air;

a second filter arrangement for filtering air passing through the passageway of the second cartridge housing construction, wherein the second field of adhesive is between the central portion of the seal member and a portion of the second cartridge housing construction and the second field of adhesive adheres the central portion of the seal member to the second cartridge housing construction;

wherein one of the first cartridge housing construction and the second cartridge housing construction defines an air inlet to provide an entrance for air into the respirator cartridge; and wherein the other of the first cartridge housing construction and the second cartridge housing construction defines an air outlet to provide an exit for the air to the respirator mask.

25. The respirator cartridge of claim 24, wherein the first cartridge housing construction defines the air inlet, and the second cartridge housing construction defines the air outlet, the air outlet further defining an attachment mechanism for attachment to the respirator mask.

* * * * *